United States Patent [19]

Chisholm, Jr.

[11] Patent Number: 4,759,741

[45] **Date of Patent: * Jul. 26, 1988**

[54] VARI-GAP DRIVE SYSTEM FOR BOX FOLDERS AND THE LIKE

[75] Inventor: Donald P. Chisholm, Jr., Merrimack, N.H.

[73] Assignee: Specialty Equipment Corporation, Worchester, Mass.

[ * ] Notice: The portion of the term of this patent subsequent to Sep. 29, 2004 has been disclaimed.

[21] Appl. No.: 916,538

[22] Filed: Oct. 8, 1986

[51] Int. Cl.[4] ..... B31B 1/88

[52] U.S. Cl. ..... 493/55; 493/181; 493/182

[58] Field of Search ..... 493/1, 2, 29, 30, 31, 493/55, 72, 71, 321–324, 357, 181, 182; 144/246 A, 247; 271/182, 202, 270; 198/836

[56] References Cited

U.S. PATENT DOCUMENTS

| | | | |
|---|---|---|---|
| 1,545,912 | 7/1925 | Maxson | 271/202 |
| 1,752,648 | 4/1930 | Matthews | 271/182 |
| 3,507,489 | 4/1970 | Wilshin et al. | 271/202 |
| 4,163,491 | 8/1979 | Rock et al. | 198/836 |
| 4,604,083 | 8/1986 | Barny et al. | 493/55 |

FOREIGN PATENT DOCUMENTS 400466 3/1974 U.S.S.R. .

*Primary Examiner*—Frederick R. Schmidt
*Assistant Examiner*—Robert L. Showalter
*Attorney, Agent, or Firm*—Robert K. Tendler

[57] ABSTRACT

A vari-gap drive system for controlling the speed of the drive system used in the fabrication of corrugated boxes which varies the drive rate for a folder vis-a-vis that of the printer/slotter to which it is attached to vary the box blank gap through the folder and thus permit a throughout two to three times faster than that attainable when the drive for the two units are driven at the same speed. The reliability and speed of the subject Vari-Gap Drive System is in part derived from a unique cage roll assembly.

6 Claims, 6 Drawing Sheets

VARI-GAP DRIVE SYSTEM FOR BOX FOLDERS AND THE LIKE

FIELD OF THE INVENTION

This invention relates to the processing of corrugated box blanks and more particularly to a method and apparatus for increasing the production rate of a system which has a printer/slotter followed by a folder.

BACKGROUND OF THE INVENTION

Presently the systems which drive box blanks through a printer/slotter and a follow-on folder are made to operate at substantially the same speed through a direct drive or tack generator system which drives all sections of the printer and the folder on a 1:1 basis. It was thought that the reason that it was necessary to drive the box blanks at the same rate was to avoid jam ups or problems in registration when the box blanks were conveyed from the printer/slotter to the folding system. When off-axis running causes tilt and jam ups, it would sometimes take at least twenty minutes to clear the jam thereby completely shutting down the entire system.

This is especially a problem when lock bottom boxes are printed and then folded, due to the fact that fingers must come down and stop portions of the lock bottom box and fold them along diagonals while the box blank is running in a given direction. The lock bottom boxes, in general, are folded at a much slower rate than are other boxes due to the fingers which lift the panels as they come out of the printer, with the lifter fingers of the folder starting to tear panels as they are lifted as the speed of the folder is increased to match that of the printer/slotter. It will be appreciated that the lifter fingers are used for pulling back panels towards the front and of at least one portion of the blank with some sort of lifter finger or lifter device used on any machine that is producing lock bottom boxes. By slowing up the process, one can accomodate the rather stringent demands of the lock bottom boxes but it reduces the rate at which the overall system may operate such that, at the very least, the printer/slotter utilized is operated at no where near its maximum capability.

It will also be appreciated that many box manufacturers utilize relatively large presses in which, a common box blank may be printed and formed which typically has an overall length of 66". However, boxes having much shorter lengths such as 36" or 26" are also printed on the same machine. What happens with the smaller type box blanks on a larger type printing machine, is that while the printing machine is able to print at a relatively fast rate, if the folding machine is directly driven by the drive for the printing machine, an exorbitant amount of space is provided between the box blanks. This results in a process which can nowhere near reach the highest possible speed if the folder could be slowed down to close the inter-blank space. It was thought that this problem could not be solved with any substantial differential in speed between the printer/-slotter and the folder due to registration problems and the aforementioned jamming which it was presumed would occur.

There was therefore a need to increase the production rate of the type of systems described above but it was not apparent that it could be done without significant jamming or running of a folding machine well beyond its rated speed capacity for the given job at hand.

Note that by the use of the term printer/slotter is meant in general a flexographic system in which either the printer, slotter, its associated feed and or associated die cutter may be used separately or in combination. Thus, the feed end of the printer/slotter may be used separately with the folder to process already printed and die-cut blanks.

SUMMARY OF THE INVENTION

In contradistinction to the prior art systems in which the belts driving the box blanks through the folding machine were tied one-to-one to the box blank drives for the printer/slotter, means are provided for changing the relative velocity of the drives in the printer/slotter vis-a-vis those of the folding machine and yet provide a jam-free folding system. This is possible because of the absolute drive synchronism despite a lack of direct drive, and is the result of the use of presently available shaft encoder and decoder systems.

The subject system can operate in three modes in which either the folding machine is operated at a slower speed than that of the printer/slotter or concomitantly, the printer/slotter is speeded up to a speed faster than that at which it would originally run and in order to obtain as much as double the through-put, with box blanks which are less than the total length of the printing press. Moreover, if there are jamming problems, the printer/slotter can be run at a slightly increased speed with the slightly decreased speed of the folding machine in general preventing jam ups which could have occurred were the folding to machine be required to run at exactly the speed of the printer/slotter.

As a further advantage to having a differential in speed with respect to the drives for the box blanks, the folding machine, if appropriate, may be made to run twice or three times as fast as the printer/slotter, assuming a two-up or three-up operation in which a box blank is processed doubly or triply and subsequently severed within the slotting portion of the machine. In this case, the increase in speed of the folding machine separates out the two-up or three-up box blanks section so that they may be appropriately folded with a sufficient gap such that jamming does not occur. Thus, while the printer/slotter is running at a slower speed, and the box folding apparatus is running at a faster speed, such that as much as a two-fold or three-fold improvement in overall production is achievable due to the gap which is provided by virtue of the speed up of the folding machine. The gap which is provided is important so that one box blank does not run up on another which, in this case, would result in a jam up; whereas, when the folder is run at a slower speed than the printer/slotter and smaller box blanks than the printer/slotter is capable of printing are utilized, then the resulting through-put is nonetheless multiplied by at least a factor of two if the printer/slotter is speeded up, with the folder running more reliably at the slower speed. Obviously having a differential in speed between the two drives permits an optimal balance between the printer/slotter speed and the folder speed so as to minimize jam ups or other deleterious affects such as off-running of box blanks.

It is a finding of this invention therefore that the drive speed of the printer/slotter vis-a-vis that of the folding apparatus may be varied in timed sequence rather than being on a one-to-one drive ratio. While the speeds of the various drives may be varied in accordance with the above in one embodiment, substantially the same ratio is maintained between the speeds such that registration is preserved due to carefully synchronized speed control.

The accommodation of the difference in speed of the blanks coming out of the printer/slotter and into the folding apparatus may be achieved, in a modified four-bar cage roll assembly as described in U.S. patent application Ser. No. 864,040 filed May 16, 1986 and incorporated herein by reference. This is done by offsetting the initial cage roll wheels upwardly such that the box blank slips into the area between the cage roll wheels and the belt, with the aft wheels being those which are the drive wheels. This permits the box blank to either speed up or slow down at the opening jaws of the cage roll assembly. Any adjustment that is made in the speed is accomplished smoothly and without off-centering of the box blank due to the provision of a non-abrupt change in speed via the friction of the lower belt of the folding machine which has very little, if any, clamping pressure initially, finally ending up with the appropriate amount of clamping pressure so that the box blank's velocity is changed without damage to the box blank or without problems with registration. It will appreciated that were there to be an abrupt change that the box blanks might bend or otherwise be damaged or thrown off of the belts. However, by providing a system which is, in essence, a soft initial clamp/hard final clamp, it is only the tail of the box, through the first set of cage roll assemblies, which is driven with such force that it finally attains the speed set for the .pa folding machine as opposed to the speed at which it came out of the printer/slotter.

Thus, regardless of the way in which the differential in speed is utilized, the combination of a printer/slotter and folder when driven at different but synchronized speeds, produces either a system in which the throughput can be doubled or in which, if the same rate of speed is utilized for the printer, at least jam ups and other registration problems are eliminated by the slow down of the folding apparatus.

A drive system which varies the drive rate for the printer/slotter vis-a-vis that of the folder includes means for sensing the drive speed of the printer/slotter and timing the speed of the belts of the folding apparatus so as to either be in timed relationship faster, slower or equal to that of the printer/slotter, thereby to increase the production rate by a factor of two or three. The ability to slow down the belts associated with the folding apparatus vis-a-vis the box blank velocity through the printer/slotter enables the utilization of a large printer to print on smaller size boxes such that the printer/slotter can be speeded up, with the slow down of the folder matching the speeded up rate of the printer/slotter. Note, the slowed down folding apparatus operates more reliably in any event. In the one operative embodiment, the slow down of the drive belts of the folder enables an increase in printer/slotter speed to over 1200 feet per minute, or approximately 13,000 boxes per hour, which doubles the production rate off the machine without increasing the speed of the folder to a point where problems such as lack of registration and misfolding occur. Alternatively, if the folding machine is experiencing off-registration or folding problems, the same rate of production can be achieved by slowing down the folding apparatus so that it operates more reliably while operating the printer/slotter at its originally designed speed.

As mentioned above, the folding apparatus can be operated at an increased speed such that while still within the folder's capability, larger uncut two-up box blanks are printed and cut in the printer/slotter, with the increase in the belt speed for the folding apparatus providing sufficient separation between the butted and cut two-up box blanks that jamming and lack of registration does not occur. This latter system increases the production rate by double or, in some cases, triple with large enough printer/slotters since the small increase in speed which speeds up the box blanks as they come out of the printer/slotter provides sufficient clearance for the folder to operate properly in a two-up or three-up type situation.

BRIEF DESCRIPTION OF THE DRAWINGS

These and other features of the subject invention will be better understood in connection with the Detailed Description taken in conjunction with the Drawings of which.

DETAILED DESCRIPTION

Figure 1:
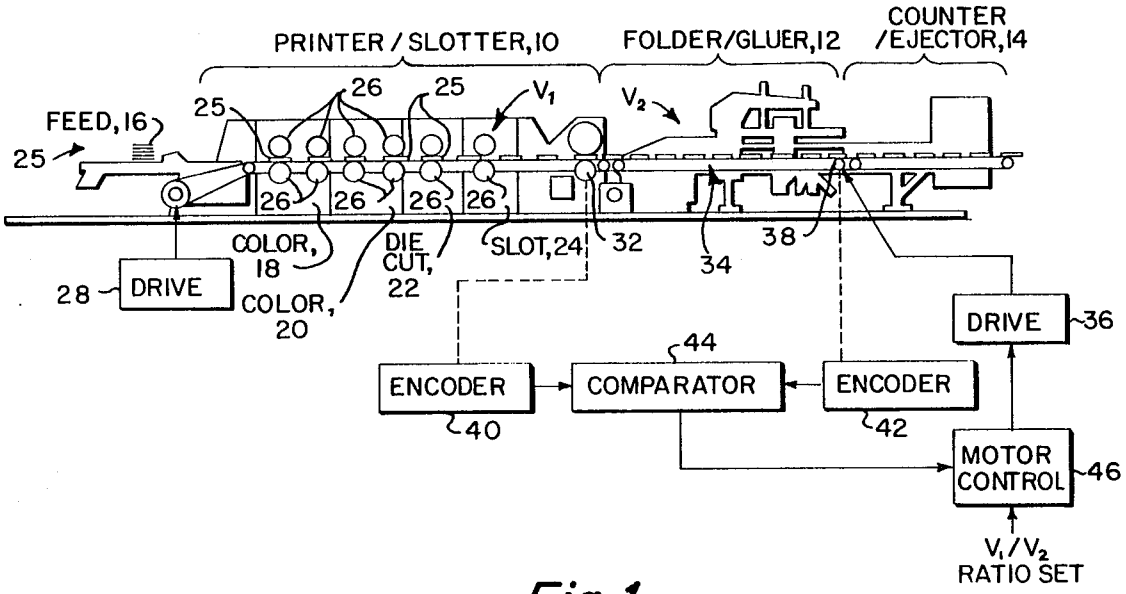
FIG. 1 is a block diagram of the subject system illustrating a variable ratio drive for the printer/slotter vis-a-vis the folder for permitting through-put increases in the numbers of blanks processed by the system.

Referring now to FIG. 1, a typical box fabrication system includes the utilization of a printer/slotter 10 coupled to a folder 12 which may have an optional gluer. This, in turn, is coupled to a counter/ejector 14. Typically, the printer/slotter includes a feed section 16 coupled to a first color printing section 18, a second color printing section 20, a die cutting section 22 and a slotting section 24, with the box blanks 25 fed from position 16 via pull rolls 26 which are driven by a drive 28 at a predetermined velocity $V_1$. It will be appreciated that when the term printer/slotter is utilized throughout the subject patent, it refers to a unit which, either prints, or die cuts, or slots or performs all or some of these functions in a 1:1 timed sequence through the machine. Thus, the box blanks move through the unit at the same speed, e.g. $V_1$. As a result, the printer may optionally have die cutting and slotting capabilities; or, alternatively, the printer may be shut off if no printing is to be done. The printer is typically one in which a printing drum having a 66" circumference is driven so as to print the top portions of box blanks, here illustrated at 28, as they are fed through the printing portion of the apparatus. It will be appreciated, however, that the subject invention is not limited to whether or not pre-slotted and die cut blanks are used; or, whether the die cutting and slotting is accomplished, as is common, after the printing process; or even as to whether or not the printer is shut off.

All that is required is that the blanks proceed through the printer/slotter 10 at a velocity $V_1$, with the exit velocity being established by pinch rolls 30 and 32 at the exit end of this unit.

As can be seen from this figure, a folder 12 with optional gluer is diagrammatically illustrated as including its own belt 34 which is driven, in accordance with the subject invention, at a velocity $V_2$ which is different from velocity $V_1$, and in one embodiment, is a predetermined ratio of the velocity $V_1$, thereby to prevent jamming or run-off conditions which could occur were a precise ratio not maintained between the velocity $V_1$ of the blanks through the printer/slotter and the velocity $V_2$ of belt 34. Belt 34 is driven by a drive 36, with the velocity of belt 34 being determined by belt pulley 38.

In order to establish the exact velocity of the drives, an encoder 40 is directly coupled to pinch roller 32; whereas, an encoder 42 is directly coupled to pulley 38. The outputs of these encoders, which may be common digital encoders such as the tack generators provided by Dynamics Research Corporation of Wilmington, Mass., are compared at a conventional comparitor 44, with the result being applied to a motor control unit 46 which controls the speed of drive 36 in accordance with a ratio of $V_1/V_2$ which is variably but preset for a given run. By comparing the blank travel speeds through the printer/slotter vis-a-vis the folder, it is possible to derive an error signal such that the predetermined ratio which is set by motor control 46 is maintained.

In the past, the velocity of drive 28 and belt 34 were identical, or within 2–3%, thereby precluding the type of productivity increase which is achievable by the subject system.

It will also be appreciated that the gluing function is additional and that it is primarily the speed of the printer/slotter with respect to the folding portion of the system that is critical in achieving the aforementioned productivity increases which depend primarily on the size of the blanks processed, the maximum size of a blank accommodated by the printer/slotter, and the stability with which the folder is operatable.

Figure 2:
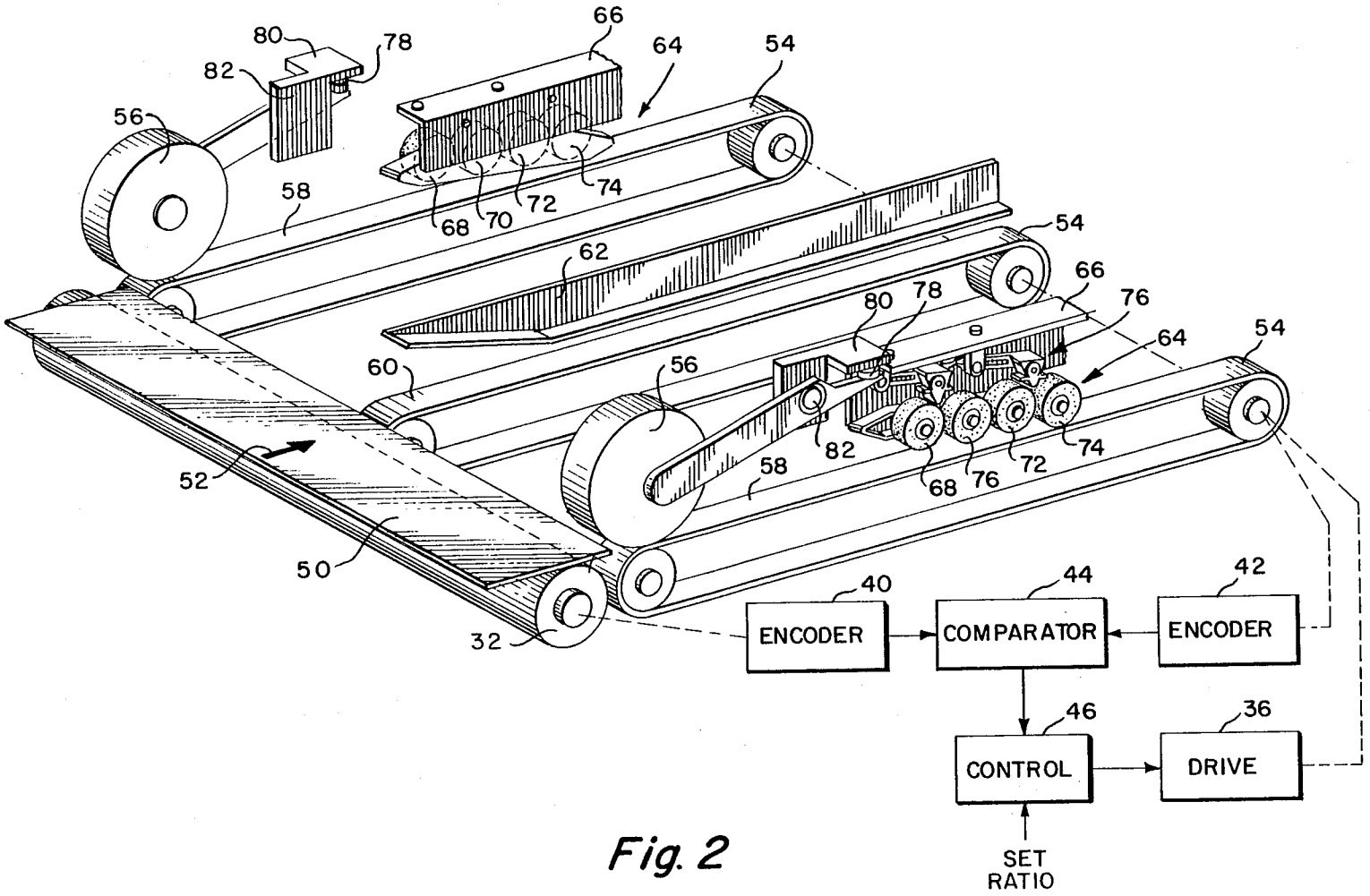
FIG. 2 is a diagrammatic and schemmatic view of the control system for controlling and varying the blank speed from the output of the printer/slotter of FIG. 1 to the input of the folder of FIG. 1, indicating weighted guide rolls and canted cage roll assemblies for accommodating the box blanks as they come out of the printer/slotter.

Referring now to FIG. 2, the output section of the printer/slotter 10 is illustrated, with roll 32 seen to move a portion of a box blank 50 moving in the direction of arrow 52 into the nip of the folder, in this case comprising driven belts 54 and weighted and pivoted entry wheels 56 which ride on the top surfaces of belts 58 as illustrated. A central belt 60 is also utilized in the driving of box blank 50 to the right. Also illustrated is a guide bar 62 to prevent box blank 52 from moving upwardly.

Figure 4:
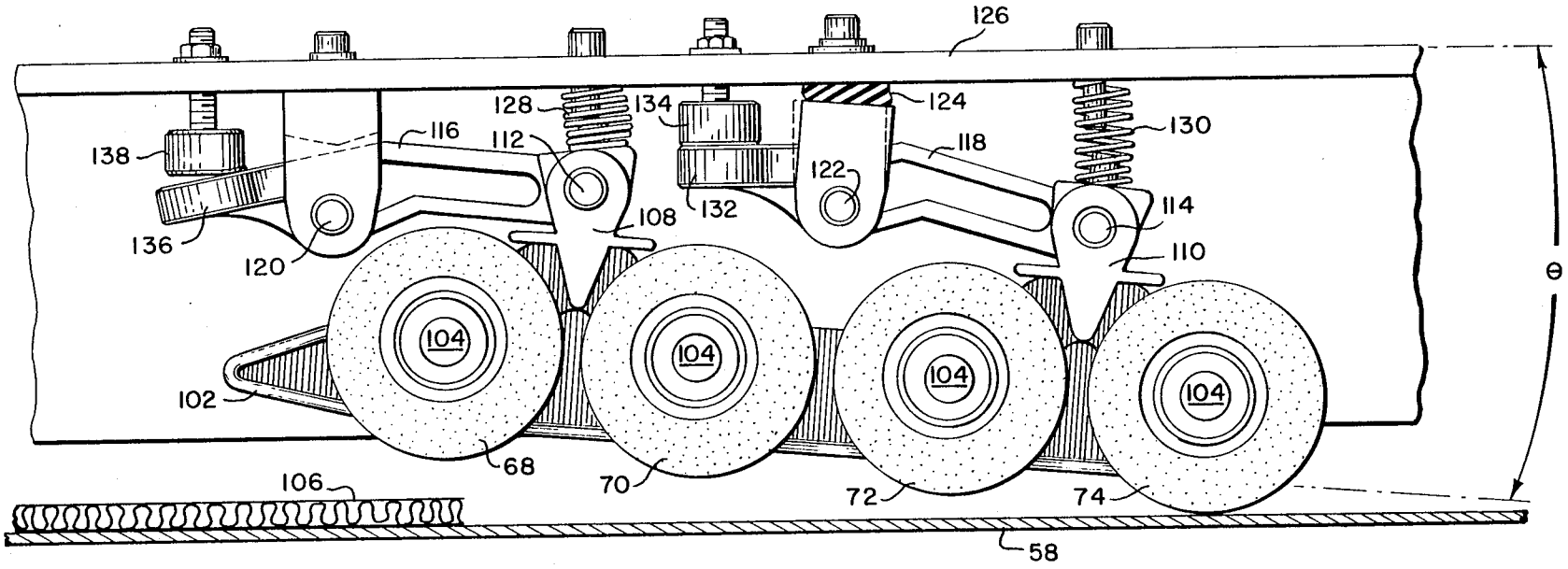
FIG. 4 is a side and diagrammatic view of a cage roll assembly usable for the input nip to the folder section of the system of FIG. 1.
Figure 5A:
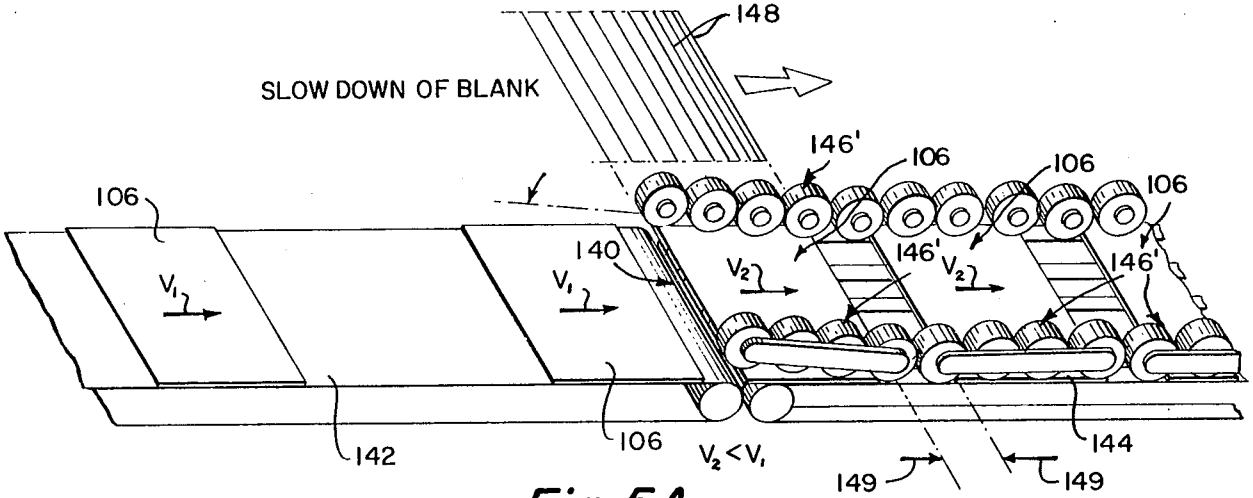
FIGS. 5A and 5B are diagrammatic illustrations showing respectively in FIG. 5A the slowing down of a blank at the nip or input of the folder, with a speed up of the blank being indicated in FIG. 5B.
Figure 5B:
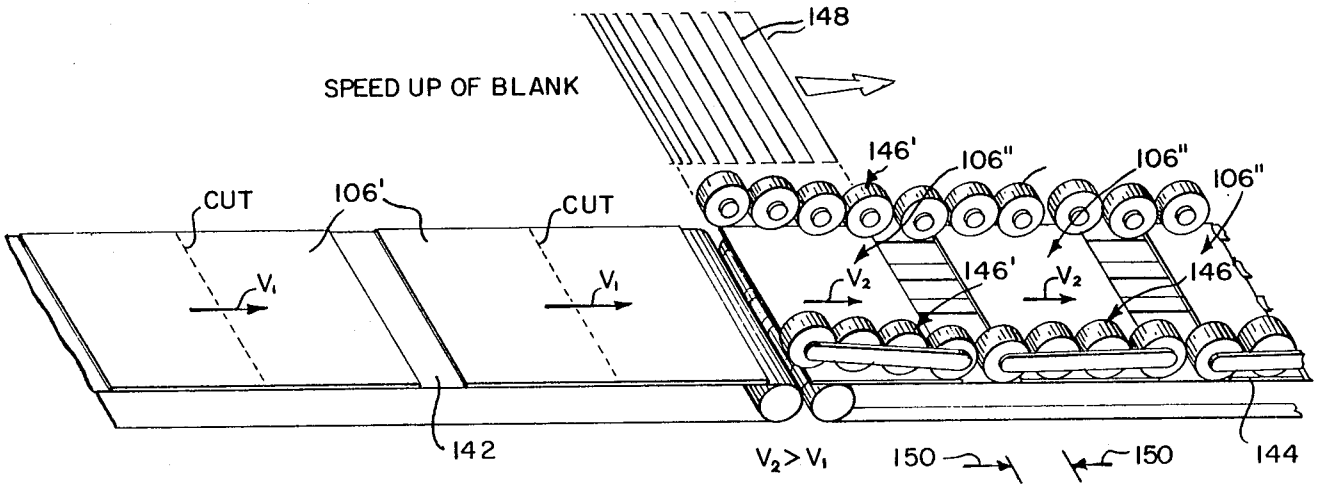

More importantly, a cage roll assembly generally indicated by reference character 64 is supported on a channel 66 and carries with it springloaded rollers 68, 70, 72 and 74 which are mounted on a modified four-bar linkage generally indicated by reference character 76 and function in the way described in the aforementioned patent included herein by reference. As will be seen from this figure and other figures, the cage roll assembly is canted upwardly both as illustrated in FIG. 4 and as illustrated in FIGS. 5A and 5B so that a variation in speed between the original speed of the blank coming out of the printer can be adjusted to the different speed of the belts associated with the folder. This permits the speed up or slow down of the blank so as to permit a variable gap spacing between the blanks, thereby to achieve the aforementioned increases in productivity due to the difference in speed between the speed at which the printer/slotter is operated and the speed at which the folder is operated.

The structure of FIG. 2 is, in part, responsible for the ability of the system to run at different speeds, due to the ability of the box blank to slip at the initial nip of the cage roll assembly as will be described in connection with FIGS. 4, 5A and 5B. The optional pivoted, weighted rolls or wheels 56 may be preset for a given gap by gapping apparatus 78 in conjunction with mount 80 and pivot 82.

It is a unique finding of the subject invention that the speed with which the printer and the folder can be operated can, in deed, be made different, especially if there is some predetermined ratio which is maintained between the speeds of the drives.

Figure 3:
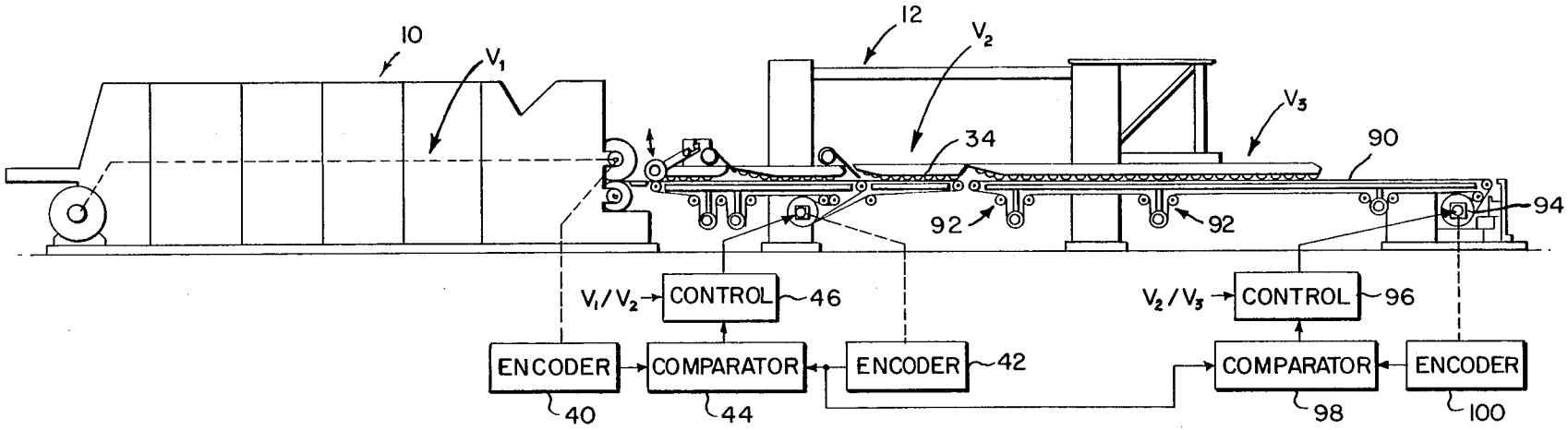
FIG. 3 is a schemmatic and diagrammatic view of the subject system illustrating the printer/slotter operated at one velocity, the folder operated at a second velocity and a remaining conveyor for the box blanks being operated at yet a third velocity.

Referring to FIG. 3, the printer/slotter 10 and the folder 12 are, as illustrated in FIG. 1, run at two different speeds, namely $V_1$ and $V_2$. Here, however, belt 34 being run at $V_2$ is placed adjacent an auxilary belt 90 which continues on in the same line, with the various pulleys and attendant apparatus generally indicated by reference character 92 run at a speed $V_3$ relative to the speed $V_2$ of belt 34. This is accomplished through the utilization of a motor 94 which is controlled by a control unit 96 similar to control unit 46. This control unit is, in turn, controlled by a predetermined ratio $V_2/V_3$ which is maintained by use of a comparator 98 which is fed via the output of encoder 42 as well as the output of an encoder 100 which is directly coupled to drive 94 of belt 90.

The same purpose is performed by virtue of having the belt 90 driven at a different speed vis-a-vis belt 34, in that whatever gapping occurs between the folded box blanks can be further controlled by virtue of the variance of the speed $V_3$ with respect to the speed $V_2$ of the respective belts. This type of control increases reliability and productivity by virtue thereof. For instance, if increased blank spacing after folding and gluing is required, this can be accomplished by virtue of the control of drive 94; whereas, if decreased interfolded box blank spacing is desirable for a speed up in the counting and ejecting process, this too can be accommodated by virtue of the difference in speed of the respective belts.

Referring now to FIG. 4, a cage roll assembly of the type described above includes the aforementioned rollers 68–74 mounted to a pointed frame member 102 which supports the rollers at center 104 for the wheels. Each of the wheels is compliant so as to permit differences in thickness of box blanks, here shown at 106, to be accommodated. The modified four-bar linkage includes bar 102 which is pivoted on supports 108 and 110 via pivots 112 and 114, coupled respectively to pivoted levers 116 and 118, respectively pivoted at fixed pivot 120 and movable pivot 122. Pivot 122 is movable because it is resiliently mounted as illustrated at 124 to frame 126, with pivots 112 and 114 being urged downardly by spring biasing means 128 and 130. The free end of pivoted bar 118, namely end 132 is adjusted by stop 134 as shown; whereas, the free end 136 of bar 116 is adjusted downwardly by stop 138 such that the entire modified four-bar cage roll assembly is pivoted upwardly as indicated by the double-ended arrow so as to provide an angular orientation with respect to the horizontal.

This type of assembly permits initial slippage of the box blank 106 at the opening nip; whereas, roller 74 provides rigid contact with the top portion of the blank as it is transported on belt 58. Thus, the velocity of blank 106 as it leaves its first cage roll assembly is that of the belt of the folder versus that of the drive belt of the printer.

This is graphically illustrated in connection with FIGS. 5A and 5B in which blanks 106 are introduced into a nip generally indicated at arrow 140. Note that the box blanks are moved at one velocity $V_1$; whereas, the velocity $V_2$ of the box blanks when clamped to belt 144 via cage roll assemblies 146 effectively, in the case of FIG. 5A, reduce the speed of the box blanks as shown by the crowding up of the leading edges 148 of the box blanks in the illustration immediately above this figure. This reduces the inter-blank gap as illustrated by arrows 149. Moreover, in FIG. 5B, the box blanks are accelerated to provide a predetermined gap here illustrated by arrows 150 for double-up box blanks 106', with the speed up of blank 106' vis-a-vis the speed of belt 142 providing for the gapping of the individual cut blanks 106'' which are shown running through the folder.

Note in both FIGS. 5A and 5B that the canted cage roll assemblies 146' put increasing pressure on the box blank moving therebeneath as the box blanks move in the direction of the arrows in these figures.

As described above, it is a finding of the subject invention that the box blanks neither run off nor jam in such an arrangement which permits the aforementioned increase in production rate depending on the size of the box blank and the speed with which the printer/slotter is operating.

Figure 6A:
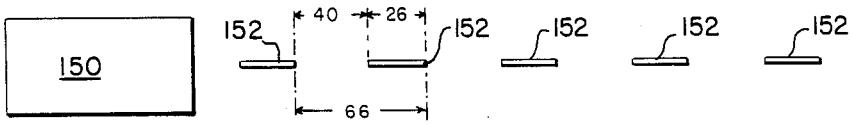
Fig. 6A (PRIOR ART)
FIG. 6A illustrates schemmatically the spacing accorded by a typical prior art printer/slotter in which box blanks smaller than the maximum capability are ejected at a given speed from the printing apparatus.
Figure 6B:
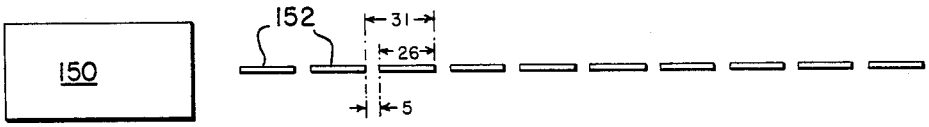
FIG. 6B illustrates schemmatically the box blanks ejected by the printer/slotter of FIG. 6A in which the inter-box blank spacing is decreased by the slowing down of the folder section vis-a-vis the speed of the printer/slotter or alternatively, the speed up of the printer/slotter vis-a-vis the speed of the folder.

This is more clearly specified in connection with FIGS. 6 - 8 in which, in FIG. 6A, a printer/slotter generally designated by reference character 150 produces, in a prior art situation, box blanks 152 which, in a typical situation are 26" box blanks, with the printer having a 66" circumferential maximum printing dimension. This results in a 40" separation between the blanks. This produces obvious wastage. To increase production and as illustrated in FIG. 6B, the folder may be operated at the same speed and the printer/slotter speed increased so that there is only a 5" gap between box blanks 152, or the folder speed may be decreased keeping the printer/slotter speed the same such, that the inter-box blank spacing can be decreased thereby to increase production.

Figure 7A:
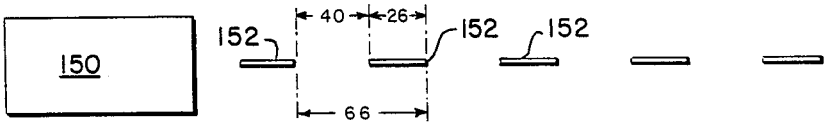
Fig. 7A (PRIOR ART)
FIG. 7A illustrates schemmatically a prior art system similar to that of FIG. 6A in which the printer/slotter is operated at a given speed with short box blanks.
Figure 8A:
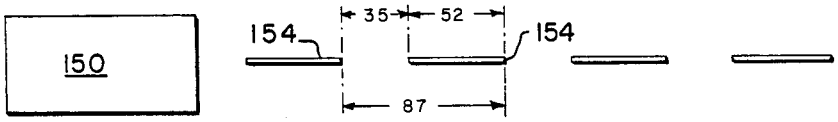
FIG. 8A illustrates schemmatically the printer/slotter producing elongated box blanks which are ejected at a speed commensurate with that of the speed of the printer/slotter with the box blanks being capable of being double-up blanks.

Again, in FIG. 7A, printer/slotter 150 is operating at its predetermined speed, with box blanks 152 being 26" long with an inter-blank spacing, in one embodiment, being 40" as above.

Figure 7B:
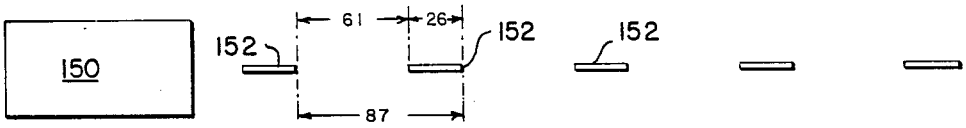
FIG. 7B illustrates schemmatically the printer/slotter of FIG. 7A operating at its originally intended speed with the box blanks being further separated to increase the inter-box blank spacing through the speed up of the folder section vis-a-vis the speed of the printer/slotter.

Referring to FIG. 7B, should it be desirable to increase the inter-blank spacing, blanks 152 may be separated by speeding up of the folder vis-a-vis the printer/-slotter or slowing down the printer/slotter vis-a-vis the folder so that should complicated folding processes require larger inter-blank spacing, this can easily be accommodated without run-off or jamming.

Figure 8B:
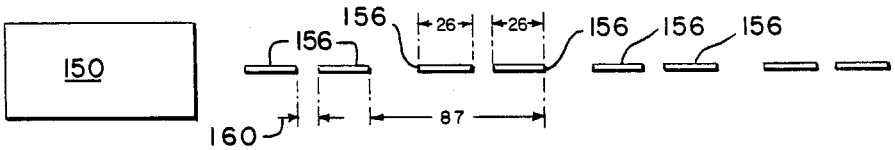
FIG. 8B illustrates schemmatically the system of FIG. 8A in which the box blanks are cut within the printer/slotter and gapped through the speeding up of the folder section such that a predetermined gap between the double-up blanks can be achieved.

Referring to FIG. 8A, again printer/slotter 150 is run at its usual speed but with box blanks 154 of a larger size; in this case 52" long. Here the printer/slotter is speeded up exactly as in FIG. 7B with the same 87" blank spacing. Note also that the inter-blank spacing is 35". As illustrated in FIG. 8B, if printer/slotter 150 were to include a cutter which would cut apart the 52" blank into 26" blanks then, with a speed up of the folder vis-a-vis that of the printer/slotter, an inter-blank gap or spacing as illustrated at arrows 160 could be made to occur, so that folder could proceed to fold the cut apart box blanks in the double-up process illustrated.

It will be appreciated that the double-up process with appropriate gapping due to the vari-gap system described above permits a potential doubling and even tripling of the speed at which the entire system can operate.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. A method for increasing the production rate of a box blank folder having a drive belt driven in timed relation to surface speed of a blank moving through a printer/slotter to which it is attached, comprising the steps of driving the drive belt of the folder at a different speed as compared to that of the surface speed of the blank through the printer/slotter;

providing continuous pressure to said blank by locating a modified four-bar cage roll assembly above said belt and extending fore and aft relative to the direction of belt movement, said assembly having as one element a frame and having fore and aft linkage arms pivoted at one end to the frame at mounts, with one mount being fixed to the frame and the other mount being compliantly mounted to the frame, and with the other ends of the arms being pivotally coupled to a bar having rollers mounted thereto; and, spring loading the bar toward the belt, with the compliancy of said one mount permitting canting of this bar with respect to the frame.

2. The method of claim 1 wherein the drive rate of the folder drive belt as compared to that of the surface speed of the blank through the printer/slotter is a fixed ratio other than 1:1.

3. The method of claim 1 wherein the drive belt of the folder runs sufficiently slower than the drive of the printer, such that the printer/slotter drive speed may be increased to process shorter box lengths than the maximum size box blanks capable of being run on the printer, or the printer/slotter can be run at its design speed for maximum size box blanks and with the folder running more reliably.

4. Apparatus for increasing the production rate of a box blank folder having a drive belt driven in timed relation to a drive of a printer/slotter to which it is attached comprising:

means for driving the drive belt of the folder at a different speed as compared to that of the drive of the printer/slotter, said belt adapted to move in a predetermined direction, said apparatus including an anti-toggling continuous contact cage roll assembly for use in the transportation of corrugated blanks along said belt comprising a modified four bar linkage system extending fore and aft relative to the direction of movement of said belt, said linkage system including two linkage arms, a frame and a bar linked to said frame by said linkage arms, with one end of each arm pivotaly mounted to respective fore and aft ends of said bar and with the other end of each arm pivotally mounted to said frame respectively in fore and aft frame mounts, with one frame mount having compliant means to permit the associated arm pivot to move, thereby to permit canting of said bar with respect to said frame, said modified four bar linkage system also including a number of rollers mounted for rotation to said bar and means for urging said bar away from said frame.

5. The apparatus of claim 4 wherein said drive means includes means for maintaining the drive rate of the folder drive belt as compared to that of the drive of the printer/slotter as a fixed ratio other than 1:1.

6. The apparatus of claim 4 wherein said drive means includes means for running the drive belt of the folder slower than the drive of the printer/slotter, whereby either the printer/slotter drive speed may be increased to process shorter box blanks than the maximum size box blanks capable of being run on the printer/slotter, or the printer/slotter can be run at its design speed for maximum size box blanks and with the folder running more reliably.

* * * * *